United States Patent [19]

Jeffrey

[11] 4,113,123

[45] Sep. 12, 1978

[54] VEHICLE OR CARRIAGE MOUNTED MATERIALS TRANSPORTING MACHINE

[75] Inventor: Ian Campbell Jeffrey, Wigan, England

[73] Assignee: Dobson Park Industries Limited, Nottingham, England

[21] Appl. No.: 617,088

[22] Filed: Sep. 26, 1975

[30] Foreign Application Priority Data

Sep. 27, 1974 [GB] United Kingdom ..... 42086/74

[51] Int. Cl.[2] ..... E02F 3/44

[52] U.S. Cl. ..... 214/141; 214/132; 299/75

[58] Field of Search ..... 214/131 A, 132, 141, 214/151, 146 R; 212/46 R, 46 A, 46 B, 55, 57; 299/73, 75; 37/117.5, 118 R, 118 A, 184

[56] References Cited

U.S. PATENT DOCUMENTS

| | | | |
|---|---|---|---|
| 1,170,654 | 2/1916 | Martin | 214/132 X |
| 2,622,749 | 12/1952 | Stuhr | 214/132 |
| 2,812,595 | 11/1957 | Drott | 37/117.5 |
| 2,949,201 | 8/1960 | MacAlpine et al. | 212/55 X |
| 3,252,606 | 5/1966 | Pryor | 37/117.5 X |
| 3,785,705 | 1/1974 | Binger et al. | 299/75 |
| 3,809,250 | 5/1974 | Pilch | 212/55 |
| 3,854,608 | 12/1974 | Arnold | 37/117.5 X |
| 3,931,898 | 1/1976 | Konstantinovich et al. | 214/141 X |

FOREIGN PATENT DOCUMENTS

| | | | |
|---|---|---|---|
| 2,328,207 | 12/1973 | Fed. Rep. of Germany | 214/132 |
| 1,484,699 | 4/1969 | Fed. Rep. of Germany | 214/132 |

*Primary Examiner*—L. J. Paperner

*Attorney, Agent, or Firm*—Brady, O'Boyle & Gates

[57] ABSTRACT

A materials transporting machine, of particular application in mining, has a boom assembly mounted on a vehicle or carriage, which boom assembly includes a telescoping boom which is maneuvering both horizontally and vertically and which can be withdrawn to a stowed position within the vehicle by utilizing pressure fluid operated means which serve for effecting telescoping movement of the boom.

9 Claims, 7 Drawing Figures

VEHICLE OR CARRIAGE MOUNTED MATERIALS TRANSPORTING MACHINE

This invention concerns improvements in or relating to vehicles or carriage mounted materials transporting machines, and has particular, though not exclusive, reference to such machines for use in mine workings.

One particular application of the invention is in the context of the removal of rock and debris from the floor of a roadway in a mine working during a heading operation by which said roadway is formed. The equipment may, for example, be used in conjunction with apparatus for stowing or packing rock or debris into the cavities formed at the side of the roadway by the mining of mineral from the mine working.

According to the present invention, there is provided a mining machine for transporting materials comprising, in combination: a mobile support means including a chassis; a boom assembly including a box-like yoke, including motion limit means comprising outwardly diverging side walls pivotally mounted directly on said chassis for motion about a generally horizontal axis and a boom slidably extensible and retractable in the direction of its length pivotally supported on said yoke for constrained motion within predetermined limits defined by said motion limit means about a generally vertical axis; means for slidably extending and retracting said boom in a direction of its length and maneuvering said boom laterally and upwardly and downwardly including a piston and cylinder arrangement secured to and extending between said support means and said yoke for moving the boom upwardly and downwardly; and a materials collecting, carrying and discharging means located on the end portion of said boom, the last-recited means comprising a dish type first section, having side and back walls joined to an angularly distending bottom wall, mounted on said end portion of the boom, a generally U-shaped complementary second section, open fore and aft, mounted on the first section in partial nesting relationship therewith, being pivotal outwardly thereof about a generally horizontal axis to form a bottom discharge opening between the sections, and fluid-operated piston and cylinder means connected between the first and second sections and adapted, upon actuation, to pivot the second section outwardly of the first section to form the bottom discharge opening.

A particularly convenient form of vehicle for the purpose of the present invention is that described in the Specification of our U.K. Pat. No. 1,334,543, the equipment according to the present invention forming a useful adjunct to the rock breaking tool carried by said vehicle.

The invention will now be described further, by way of example only, with reference to the accompanying drawings in which.

Figure 4:
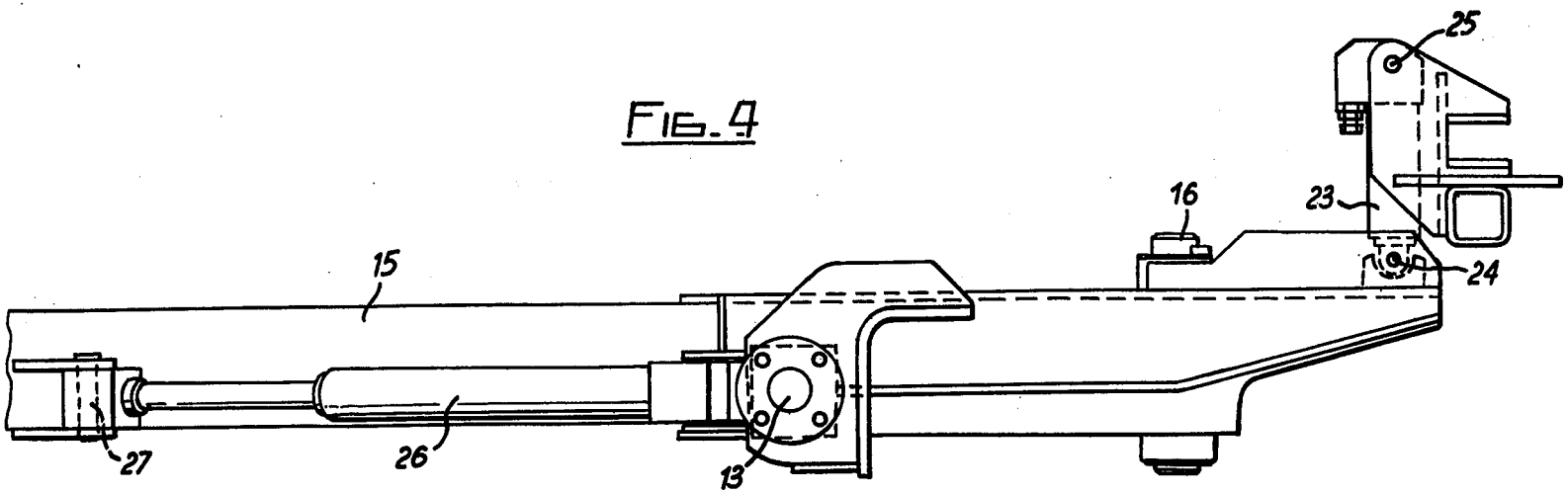
Figure 5:
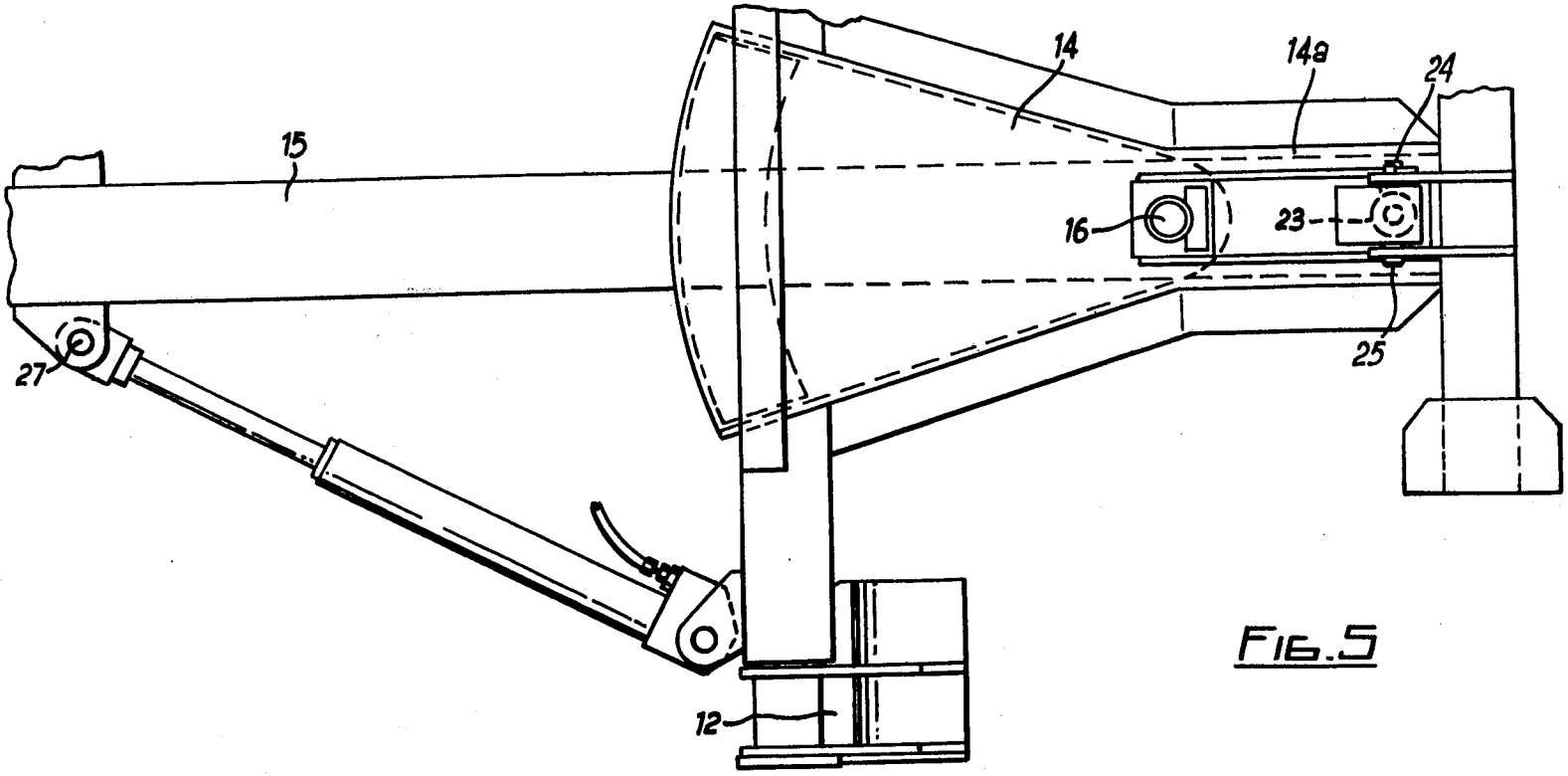
Figure 6:
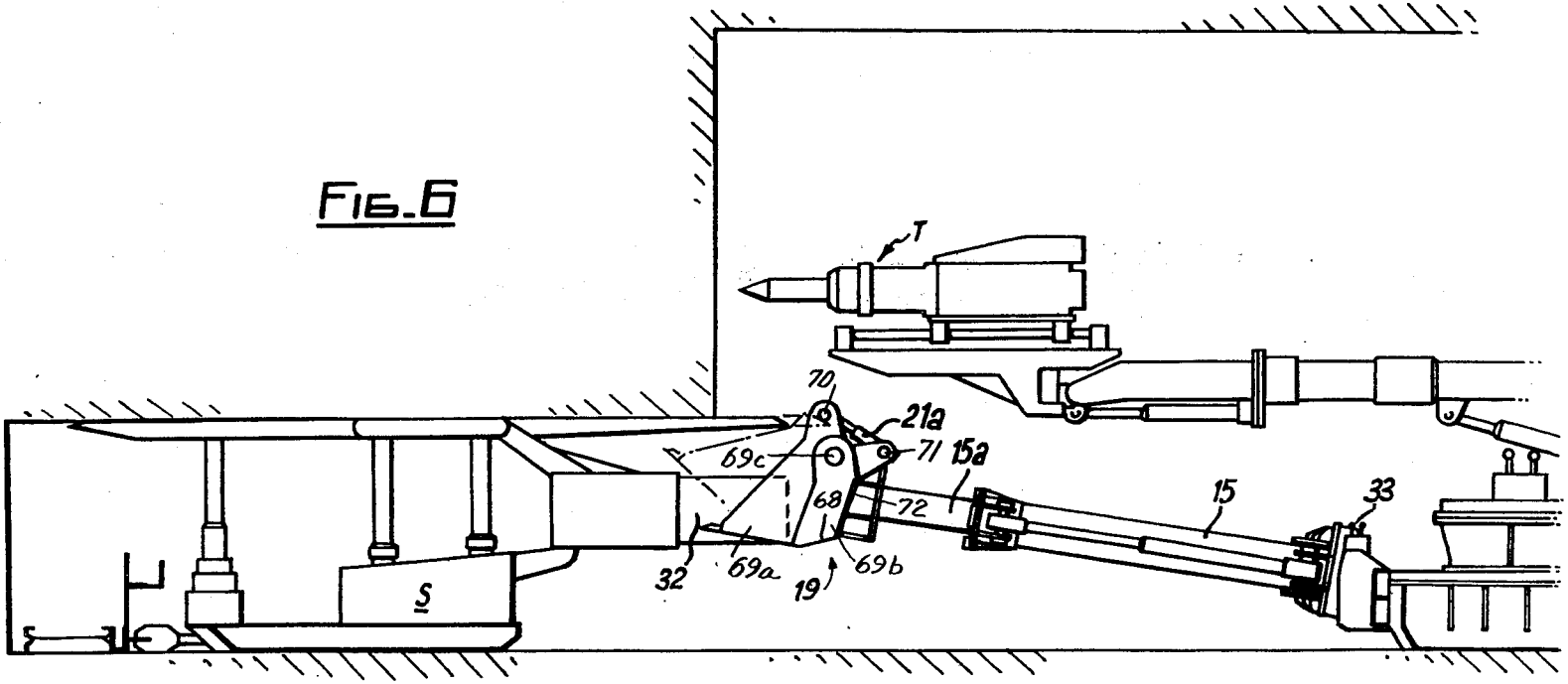
Figure 7:
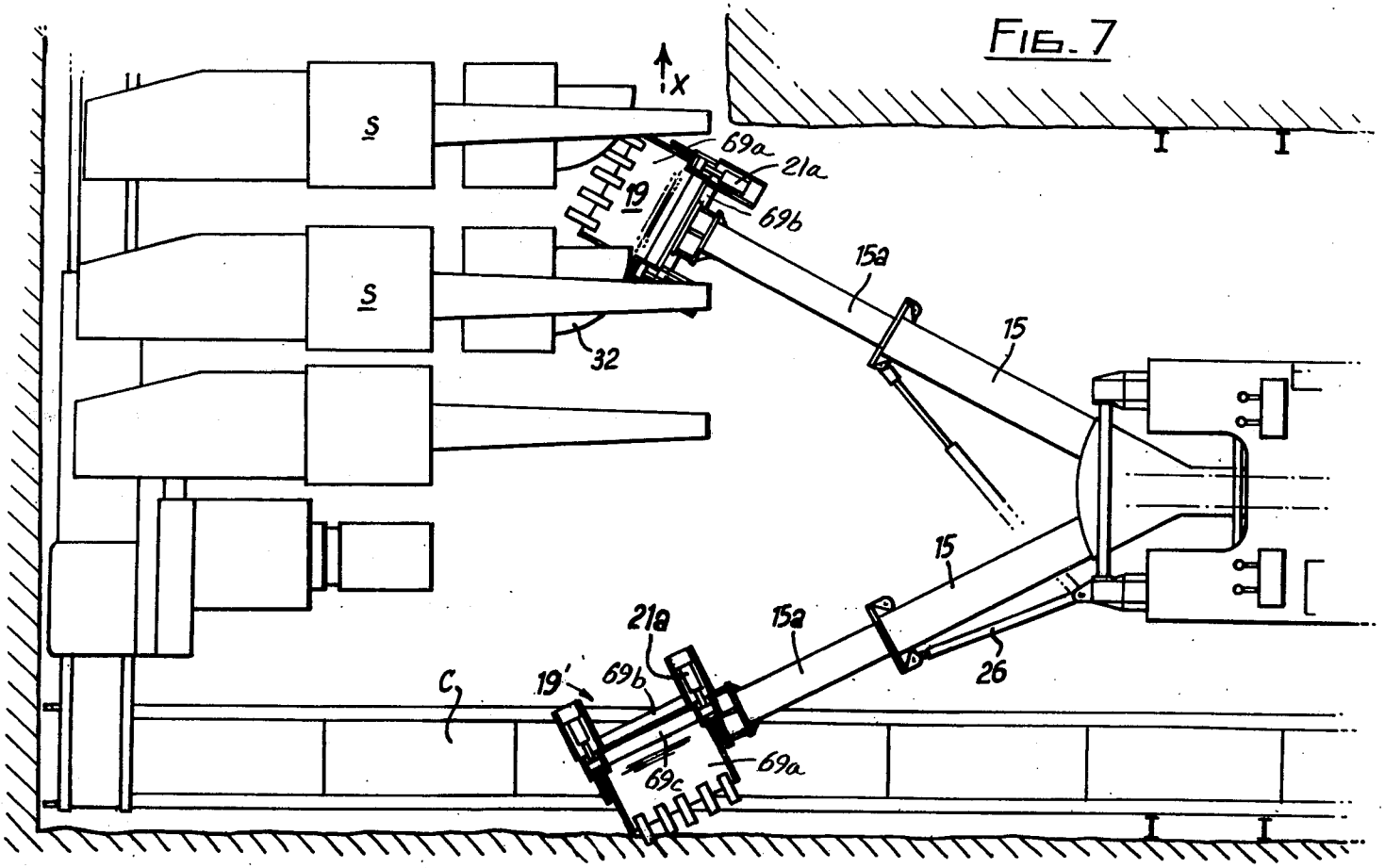

FIGS. 4 and 5 show, in side elevation and plan view, respectively, an alternative mounting and lifting arrangement for the boom of the materials collecting, carrying and discharging means; and FIGS. 6 and 7 are a semi-diagrammatic side elevation and a plan view, respectively illustrative of the use of the machine at the road head in a mine working in conjunction with a rock breaking tool of the kind described in the Specification of our prior British Pat. No. 1,356,022, and shows the preferred materials collecting, carrying and discharging means of the invention.

Referring now to the drawings, the reference numeral 10 indicates a walking vehicle constructed in the manner described in the Specification of our prior British Pat. No. 1,334,543.

In addition to carrying a boom and rock breaking tool T (shown in FIG. 6) as described in the aforementioned Specifications, the vehicle is adapted to carry mineral transporting equipment.

Figure 1:
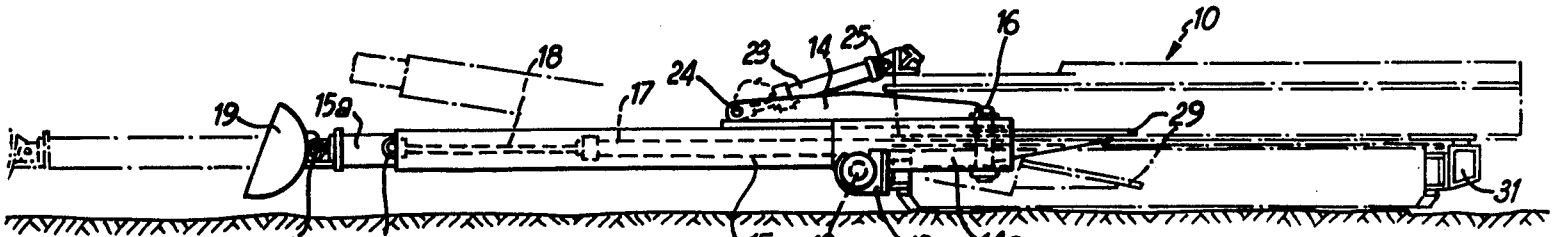
FIG. 1 is a side elevation of a machine having a materials collecting, carrying and discharging means thereon.
Figure 2:
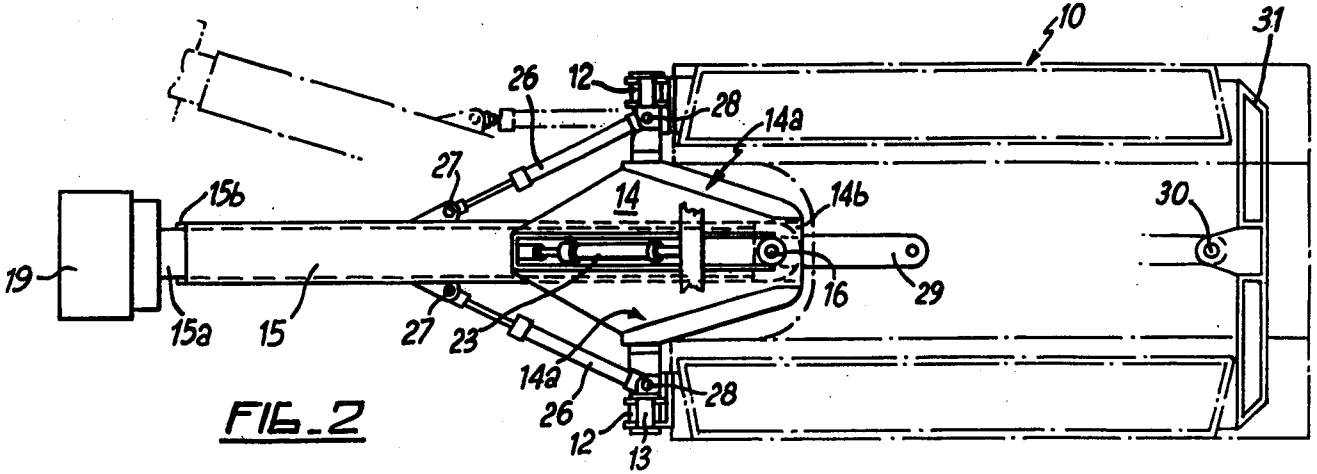
FIG. 2 is a plan view of the arrangement shown in FIG. 1.

Thus, referring now particular to FIGS. 1 and 2, the vehicle is provided on opposite sides with brackets 12 pivotally supporting, at 13 a partially box-like yoke 14 having side walls **14*a* which diverge from a throat-like portion 14*b***.

An elongated tubular or box section member 15, forming part of a boom, is pivotally anchored to the yoke 14 at 16 and is free to swing laterally between the limits provided by the side walls **14*a*** of the yoke, the yoke serving to support the boom whilst allowing unrestricted movement of such boom within the range of operation.

The boom also includes a tubular member **15*a* which is slidable in the member 15 so as to be extensible and retractable relatively thereto. Extension and retraction of the boom member 15*a* is effected by a double-acting hydraulic ram having its cylinder 17 (FIG. 1) anchored to the pivot pin 16 and its piston rod 18 anchored to the member 15*a* at 18*a*. The member 15*a* has a collar 15*b* which, when said member is retracted into the member 15**, engages the forward end of the latter.

Figure 3:
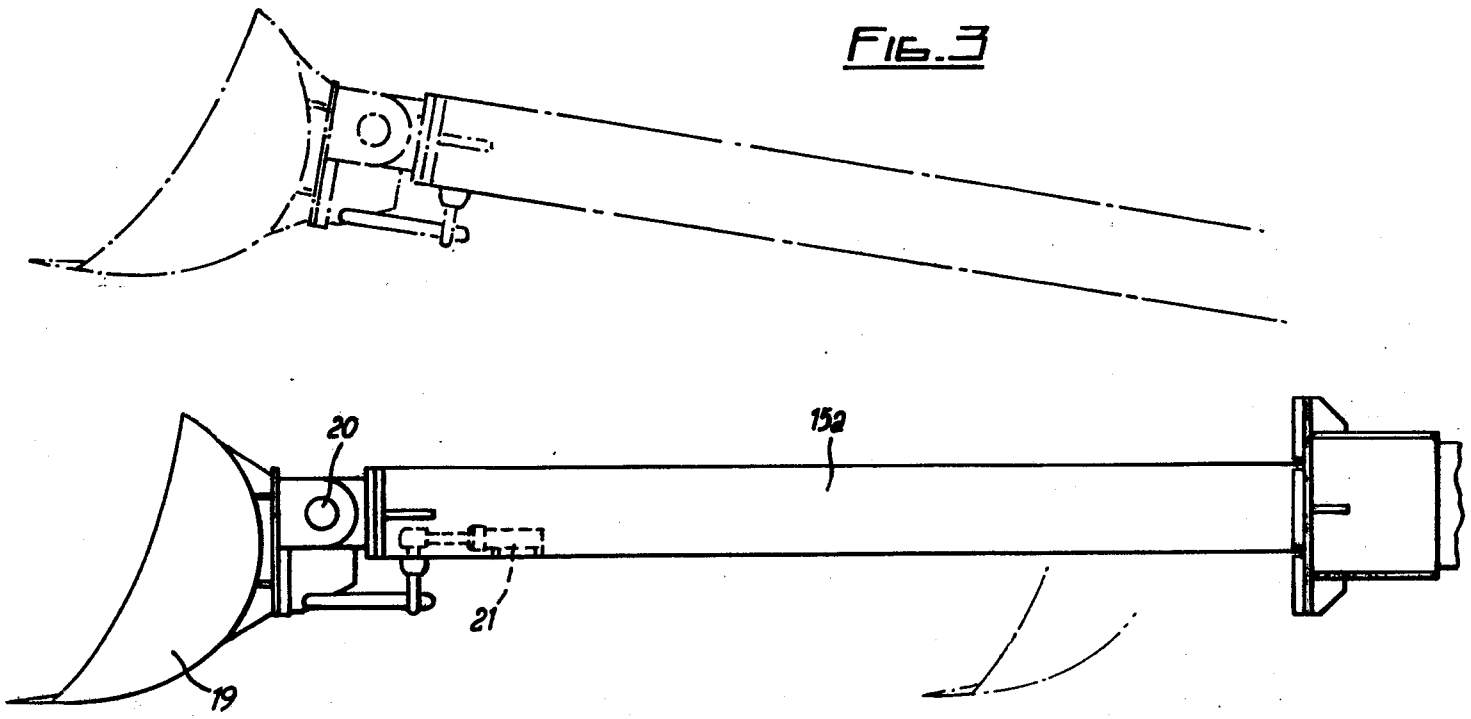
FIG. 3 is a detail view of the tiltable bucket incorporated in the machine shown in FIGS. 1 and 2.

The member **15*a* terminates, at its forward end, in a bucket 19 (see FIG. 3) pivotally connected to said member at 20, forward and rearward tilting of the bucket 19, about its pivot 20 being effected by a double-acting pressure-fluid-operated ram 21**.

Raising and lowering of the yoke 14 about its pivots 13, and thereby raising and lowering of the boom 15, **15*a* is effected by a hydraulic ram 23 anchored at 24 to the yoke and at 25** to the chassis of the vehicle.

Lateral movement of the boom 15, **15*a*, about the pivot 16, is effected by two hydraulic rams 26 provided one at each side of the boom and each pivotally connected to the member 15 at 27 and to the yoke 14 at 28**.

To stow the boom 15, **15*a* under the chassis of the vehicle such boom is fully retracted so that the collar 15*b* on the boom member 15*a* abuts the forward end of the boom member 15. The pivot pin 27 and/or the pivot pin 28 are then removed, the pivot pin 16 is disconnected from the yoke 14, and the ram 17, 18 is extended rearwardly to bring a link 29, coupled to the pivot pin 16, into a position for anchoring thereof to a lug 30 on the rear of the vehicle. On subsequent retraction of the ram 17, 18, the boom 15, 15*a* is retracted bodily and longitudinally into the required stowed position under the chassis of the vehicle, being guided, during this stowing movement by the throat position 14*b*** of the yoke.

Suitable brackets, or other means, may conveniently be provided for holding the ram 26 in position when the boom is retracted.

Provision may be made on the rear of the vehicle as at 31, for a weight to counterbalance the weight of the boom.

In the modification shown in FIGS. 4 and 5, in which like reference numerals to those of FIGS. 1 and 3 and FIGS. 6 and 7 are used for the same, or similar parts, the ram 23 is pivotally connected, at 24 to the yoke at a position behind the yoke pivots 13, in relation to the bucket the pivotal connection 25 of the ram to the chassis being substantially vertically above.

FIGS. 6 and 7 show a materials transporting machine having a loader bucket 19 of a preformed form, such bucket 19 comprising a generally U-shaped forward section 69*a* open fore and aft, and a dish type rearward section 69*b* having side and back walls joined to an angularly distending bottom wall 68, the sections 69*a* and 69*b* being pivotally connected together by shaft 69*c* and having respective lugs 70 and 71 each side thereof which extends outwardly from the related part and at that side thereof remote from the pivot axis as defined by the axis of shaft 69*c*.

The forward section 69*a* is of lesser transverse dimensions than the rearward section 69*b*, and partially seats within such rearward part, as can be seen from FIG. 6.

A respective hydraulic ram 21*a* is provided between each pair of corresponding lugs 70 and 71, the said rams 21*a* being adapted, upon actuation, to pivot the forward section 69*a* relative to the rearward section 69*b*, thus to move the forward section 69*a* outwardly from its position of partial seating in the rearward bucket section 69*b*, to discharge the contents of the bucket, the "open'-'condition of the forward part 69*a* of the bucket being shown, in part, in dotted lines in FIG. 6.

As is apparent from the drawing, the bucket 19 is mounted on the forward end of ram 15*a* by the attachment of the back wall 72 to such ram.

In FIGS. 6 and 7 the machine is shown operating in the region of the road-head of a mine working, the bucket 19 being used to gather mineral and debris from the floor of the working and transport it to and deposit it behind the roof supports S which extend along the mineral face being worked. The supports S have known devices 32 pivoted to the supports and operated sequentially by rams so as to pack the mineral and debris, collected by the bucket, in the direction of the arrow X.

If intended for loading mineral and debris collected from the floor into the roadway conveyor C the boom will be fitted with a side-loading and discharging bucket as shown in the lower part of FIG. 7, instead of the forward loading and discharging bucket shown in the upper part of the drawing, the forward part of the bucket being tiltable about an axis co-axial with or parallel to the axis of the boom or transversely of such axis according to whether the bucket is side-loading or forward-loading. In some circumstances it may be found advantageous to provide two booms, one being fitted with a forward-loading and discharging and the other with a side-loading and discharging bucket, each boom having a respective limited range of lateral movement.

With the bucket arrangement as shown in FIGS. 6 and 7, upon the charging thereof with spoil, the load carried acts under gravity to maintain the two bucket parts in a relative disposition consistent with a "closed" condition of the arrangement, such facility arising from the location of the load-bearing part of the bucket arrangement forwardly of the pivot axis.

Operation of the bucket may be controlled by a man working alongside the machine, the machine being provided with bucket control levers 33 as shown in FIG. 6.

The invention is not restricted to the exact features, of the embodiments hereinbefore disclosed, since alternatives will readily present themselves to one skilled in the art.

What we claim is:

1. A mining machine for transporting materials comprising in combination:

mobile support means including a chassis;

a boom assembly including a box-like yoke, including motion limit means comprising outwardly diverging side walls pivotally mounted directly on said chassis for motion about a generally horizontal axis and two independently operable booms having mutually exclusive arcs of operation slidably extensible and retractable in the direction of their respective length pivotally supported on said yoke for constrained motion within predetermined limits defined by said motion limit means about a generally vertical axis;

means for slidably extending and retracting said booms in a direction of their length and maneuvering said booms laterally and upwardly and downwardly including a piston and cylinder arrangement secured to and extending between said support means and said yoke for moving the booms upwardly and downwardly;

and a materials collecting, carrying and discharging means located on the end portion of each said booms, said last-recited means comprising a dish type first section, having side and back walls joined to an angularly distending bottom wall terminating in a forwardly projecting bottom wall portion, mounted on said end portion of the respective boom, a generally U-shaped complementary second section, open fore and aft, mounted on said first section and having a bottom wall in partial inwardly nesting relationship with said forwardly projecting bottom wall portion, being pivotal outwardly thereof about a generally horizontal axis to form a bottom discharge opening between the sections, and fluid-operated piston and cylinder means connected between the first and second sections and adapted, upon actuation, to pivot the second section outwardly of the first section to form the said bottom discharge opening.

2. A mining machine as claimed in claim 1, wherein said first and second sections have respective lugs extending outwardly from the upper extremities thereof, said lugs providing connecting means for said piston and cylinder means.

3. The mining machine as defined by claim 2 wherein said lugs extend outwardly in mutually opposite directions.

4. A mining machine as claimed in claim 1, wherein said first section has an upwardly angulated tab portion extending rearwardly above the back wall and said second section has an upwardly extending tab portion above said generally horizontal axis, said tab portions having lugs located thereon for providing connecting links for said piston and cylinder means.

5. A mining machine as claimed in claim 4, wherein the axis of pivotal motion of said second bucket loader section relative to said first section lies rearwardly of the bucket loader in relation to the load supporting surface of the generally U-shaped second bucket loader section.

6. The mining machine as defined by claim 1 wherein said forwardly projecting bottom wall portion of said first section is generally aligned with the longitudinal axis of the respective boom.

7. The mining machine as defined by claim 6 wherein the bottom wall of said second section is aligned with the forwardly projecting bottom wall portion of said first section when in said partial inwardly nesting relationship therewith.

8. A mining machine for transporting materials comprising in combination:

mobile support means including a chassis;

a boom assembly including a box-like yoke, including motion limit means comprising outwardly diverging side walls pivotally mounted directly on said chassis for motion about a generally horizontal axis and two independently operable booms having mutually exclusive arcs of opertion slidably extensible and retractable in the direction of their respective length pivotally supported on said yoke for constrained motion within predetermined limits defined by said motion limit means about a generally vertical axis;

means for slidably extending and retracting said booms in a direction of their length and maneuvering said booms laterally and upwardly and downwardly including a piston and cylinder arrangement secured to and extending between said support means and said yoke for moving the booms upwardly and downwardly;

and a materials collecting, carrying and discharging means located on the end portion of each of said booms.

9. The mining machine as defined by claim 8 wherein the two booms carry forward loading and side-loading materials collecting, carrying and discharging means, respectively.

* * * * *